US006842987B1

(12) United States Patent
Martinsson et al.

(10) Patent No.: US 6,842,987 B1
(45) Date of Patent: Jan. 18, 2005

(54) TRIGGER DEVICE FOR CHAIN BRAKE

(75) Inventors: Pär Martinsson, Jönköping (SE); Peter Björkman, Aneby (SE)

(73) Assignee: Aktiebolaget Electrolux, Stockholm (SE)

( * ) Notice: Subject to any disclaimer, the term of this patent is extended or adjusted under 35 U.S.C. 154(b) by 130 days.

(21) Appl. No.: 10/148,515

(22) PCT Filed: Nov. 20, 2000

(86) PCT No.: PCT/SE00/02276

§ 371 (c)(1),
(2), (4) Date: Jul. 8, 2002

(87) PCT Pub. No.: WO01/39942

PCT Pub. Date: Jun. 7, 2001

(30) Foreign Application Priority Data

Dec. 2, 1999 (SE) ..... 9904364

(51) Int. Cl.[7] ..... B23D 57/02; B27B 17/02
(52) U.S. Cl. ..... 30/382; 30/381
(58) Field of Search ..... 30/351, 382, 383, 30/384, 385, 386; 188/77 R, 77 W; 192/17 R

(56) References Cited

U.S. PATENT DOCUMENTS 4,335,514 A * 6/1982 Overy et al. ..... 30/382
4,635,364 A * 1/1987 Noll et al. ..... 30/381
4,721,193 A * 1/1988 Nagashima ..... 192/17 R
4,753,012 A * 6/1988 Schurr ..... 30/382
4,793,064 A * 12/1988 Nagashima ..... 30/382
4,811,487 A * 3/1989 Takahashi et al. ..... 30/382
5,101,567 A * 4/1992 Cool ..... 30/382
5,233,750 A * 8/1993 Wolf et al. ..... 30/382
5,580,008 A 12/1996 Koegler et al.
5,640,773 A * 6/1997 Haertlein ..... 30/382
6,105,263 A * 8/2000 Stones et al. ..... 30/382

FOREIGN PATENT DOCUMENTS

| | | |
|---|---|---|
| EP | 0 210 997 B1 | 1/1989 |
| EP | 0 945 234 A2 | 9/1999 |
| EP | 0 945 234 A3 | 1/2002 |
| WO | 86/004294 | 7/1986 |

OTHER PUBLICATIONS

Skogen, vol. 1, 1990, Bengt–Åke Alriksson, "Förbättrat V–skydd passar flera sågmodeller", pp. 40–41.
Jord & Skog, vol. 12, 1987, Johan Löfgren, "Äntligen ett fungerande kastskydd", pp. 32–33.

* cited by examiner

*Primary Examiner*—Hwei-Siu Payer
(74) *Attorney, Agent, or Firm*—Pearne & Gordon LLP

(57) ABSTRACT

A brake triggering device with a pivotably mounted trigger arm (1) located in connection to a handheld working tool's, mainly a chain saw's (2), rear handle (3), with a throttle control (4) and a handle opening (5) located below the handle (3), so that the trigger arm (1), when the saw changes inclination in relation to the operator's forearm, e.g. at the event of kickback or fall, is actuated by the operator's hand or arm, whereby the trigger arm (1) via a transfer mechanism actuates a brake (9) so that this stops the movement of the saw chain. The pivot (10) of the trigger arm is located in connection to a front (11) or a bottom (12) side of the handle opening (5).

36 Claims, 5 Drawing Sheets

TRIGGER DEVICE FOR CHAIN BRAKE

This application claims the benefit of International Application Number PCT/SE00/02276, which was published in English on Jun. 7, 2001.

TECHNICAL FIELD

The subject invention refers to a brake triggering device with a trigger arm located in connection to a handheld working tool's, mainly a chain saw's, rear handle with a throttle control and a handle opening located below the handle, so that the trigger arm, when the saw changes inclination in relation to the operator's forearm, e.g. at the event of kickback or fall, is actuated by the operator's hand or arm, whereby the trigger arm via a transfer mechanism actuates a brake to stop the movement of the saw chain.

BACKGROUND OF THE INVENTION

When using a chain saw there is a risk of several kinds of severe accidents.

There might be so-called kickback accidents, i.e. the saw bar with its rotating saw chain is swung up towards the saw operator. There might be fall accidents, when the user perhaps slips and falls over the saw with its rotating saw chain. In order to reduce the risk of damages at the event of kickback the chain saw is normally equipped with a chain brake that is actuated by a so-called kickback guard. This is mounted in front of the chain saw's front handle, a so-called handle frame. At the event of kickback the user's forehand often hits the kickback guard, which then actuates the chain brake. The chain brake can also be actuated due to the inertia of the kickback guard when the rapid kickback occurs. However, there might be accidents due to slow kickbacks, or when the user falls over the saw, where it might be a great risk that the above-mentioned trigger principles would not function.

PCT Application Publication No. WO 86/04294 (which corresponds to Swedish Patent No. 441992) describes a trigger device for a kickback guard that is so designed that it can be actuated by the rear hand. A trigger handle is located above the rear hand and is entirely mechanically connected to the chain saws ordinary kickback guard located in front of the front handle frame. The trigger handle is thus connected to the engine unit that is not equipped with vibration damping, while the rear handle as well as the handle frame are isolated from vibrations. This is a clear disadvantage. A redesigned version has been produced and marketed, where a trigger handle is mounted to the rear handle and connected via a wire to a trigger mechanism for the chain brake. The trigger arm is designed as a lever journalled a few centimeters above the saw's throttle control. This location of the journal results in that the angle of the operator's arm will not correspond particularly well with the angle of the trigger arm so that the trigger arm will chafe against the arm, both at easy contact or at strong contact, i.e. at an actual release. Furthermore, the trigger wire in this design would have to be drawn totally unprotected at the outside of the saw over a great deal of its length. Hereby there is a risk that it might be damaged.

PURPOSE OF THE INVENTION

The purpose of the subject invention is to substantially reduce the above-mentioned problems in a trigger device with a trigger arm located in connection to a portable working tool's rear handle.

SUMMARY OF THE INVENTION

The above-mentioned purpose is achieved in a device in accordance with the invention having the characteristics appearing from the appended claims.

The trigger device in accordance with the invention is thus essentially characterized in that the pivot of the trigger arm is located in connection to a front or a bottom side of the handle opening. Hereby the trigger arm will get a more favorable geometry of motion more corresponding to the motion of the arm at the event of kickback etc. Comparing with the known solution such a change could appear as evident. However, it means that a great number of changes have to be made on the tool to enable this location of the pivot of the trigger arm. The handle part must be adapted to make place for the trigger arm, which in turn must be given a complicated design to be able to cooperate with the handle part without intruding on the necessary space in the handle opening. The location of the pivot of the trigger arm also results in that the trigger mechanism can be given a much more protected location, e.g. the transfer wire can be drawn entirely protected at the same time as it can be given a considerably shorter and straighter drawing than in the earlier known design.

The invention is mainly intended to be used for chain saws run by internal combustion engines or electric engines. However, it could also be used for other portable working tools with a rear handle, mainly tools of the cutting type. One example is a chain saw provided with a saw wire or similar instead of a saw chain. Another example is a cutting machine, at least if it is provided with a relatively small and light cutting disc. For, a large cutting disc has a very large moment of inertia. When its rotational speed has to be stopped rapidly by a triggered brake this would result in a very strong reactive moment that tends to twist the tool downwards. Then there is a great risk that the operator would cut his foot or bone before the disc has stopped.

Further characteristics and advantages of the invention will be apparent from the detailed description of preferred embodiments and with the support of the drawing figures.

BRIEF DESCRIPTION OF THE DRAWING

The invention will be described in closer detail in the following by way of various embodiments with reference to the accompanying drawings, in which the same numbers in the different figures state one another's corresponding parts.

FIG. 5 shows the backside of the clutch housing with components.

DESCRIPTION OF PREFERRED EMBODIMENTS

Figure 1:
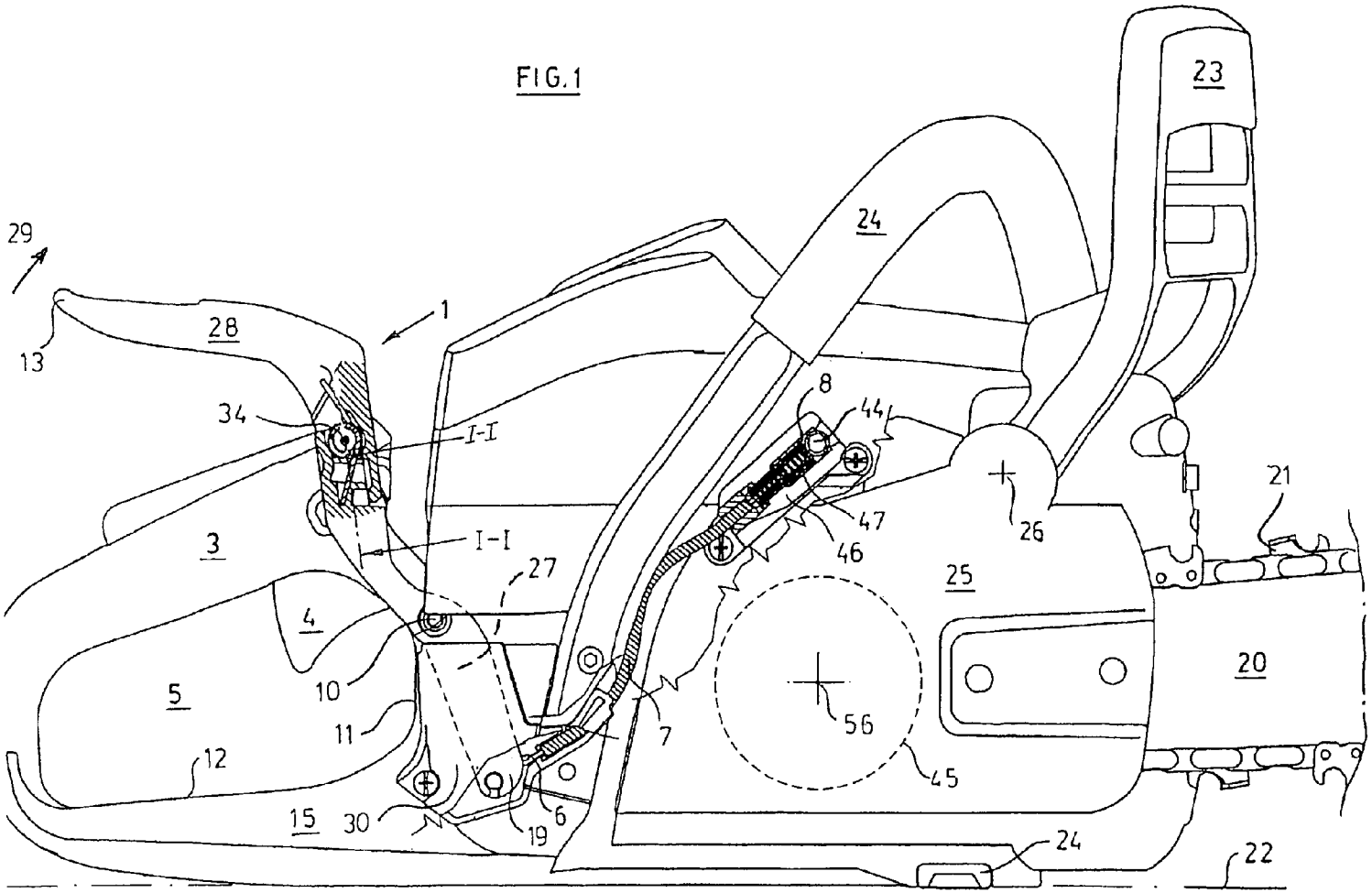
FIG. 1 shows a side view of a chain saw equipped with the trigger device in accordance with the invention.

In the partly schematic FIG. 1 a chainsaw or a power saw has a saw bar 20 and a saw chain 21. In the following forwards is meant as the direction of the saw bar 20, while downwards also means downwards in the figure. For example, the saw could be placed on the ground designated by numeral reference 22. The saw has an ordinary handle frame 24 with a kickback guard 23 located in front of it. It has a rear handle 3 with a throttle control 4 and a handle opening 5 located below the handle 3. A clutch housing 25 is provided with a brake device, which will be actuated by the kickback guard 23 when this turns forwards. This is pivotably mounted at the pivot point 26. All this is conventional and will therefore not be described in closer detail. What is characteristic are the trigger arm 1 and the transfer mechanism 6, 7, 8, which actuates a brake 9, so that this stops the movement of the saw chain if the trigger arm 1 above the handle 3 is affected to create a rotation in the direction of the arrow 29 around the pivot 10 of the trigger arm. This pivot is located in front of the handle opening 5. Hereby a favorable geometry of motion is created where the protruding outer end 13 of the arm is moving forwards and upwards, as shown by the arrow 29. The rear handle 3 is arranged in handle unit 15, which extends under the saw body and to which the front handle frame 24 is attached, partly to the underside of the saw at the one end of the handle frame, and partly at the other end of the handle frame. This unit, thus containing both the front handle and the rear handle, is then anti-vibration mounted to the other part of the saw. Normally also the fuel tank is integrated in this anti-vibration mounted handle unit. Below its pivot 10 a cover 30 conceals the trigger arm 1. This is cut up at its underside in order to clearly illustrate the arm's other outer end 19, which is connected to a part of the transfer mechanism, e.g. a wire 6. The wire 6 extends in its casing 7. The wire with its casing is located inside the handle frame 24, which in the drawing is shown in a cut up mode in order to illustrate the wire in its casing. The handle frame 24 is thus secured to the handle unit 15, which comprises both the front handle and the rear handle.

Consequently, in this case the trigger arm 1 is embodied as a double-armed lever. Furthermore it comprises a bottom part 27 and a top part 28. These are pivotally connected to each other at the pivot point 34 and spring-loaded against a stop in the position shown in the figure. This becomes evident from a cross-section adjacent to the pivot. This means thus that under load in the direction of the arrow 29 the parts 27 and 28 will be butt joint to each other. If on the other hand there is a load in the opposite direction the part 28 will rotate in relation to the part 27 under spring-load. This is a feature that is used to prevent the trigger arm 1 from breaking into pieces in case the saw might get jammed or similar. However, this feature is not absolutely necessary. The figure shows a very favorable embodiment of the trigger arm where the pivot is located in front of the handle opening but in connection to a front side of the handle opening. To place it even more far ahead from the handle opening would not be any advantage, and to place it at the very handle opening would result in that the trigger arm would intrude upon this somewhat, which is disadvantageous, but still quite possible if the size of the handle opening 5 should be adapted. Obviously the pivot 10 could as well be displaced either upwards or downwards with a maintained function of the double-armed lever. However, it is also possible to place the pivot 10 in connection to a bottom side 12 of the handle opening. See FIG. 5 for one example. In case the trigger arm should be embodied as a single-armed lever, then the illustrated location of the attachment of the wire could in fact be maintained. The moving direction of the wire and the lever-ratio would of course be affected by where the pivot is located, but it is evident that it can be located in connection to either a front side 11 or a bottom side 12 of the handle opening 5. And, of course also any intermediate location between both these. The other end 19 of the lever is preferably provided with apertures for wire-attachment in the conventional way, such as a bicycle hand brake for example. As becomes apparent from FIG. 1 the lower part of the wire is located entirely protected behind the cover 30 and the handle frame 24. It has a very short and straight run. Over its entire length it is protected by lying either under or deeper than the cover 30, the handle frame 24 and the clutch housing 25. Obviously, this is a major advantage.

Figure 2:
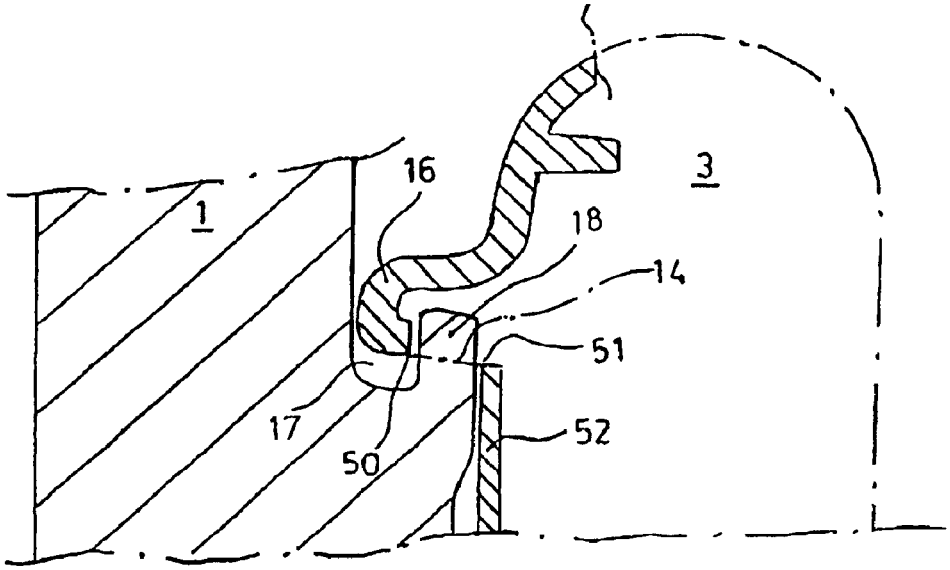
FIG. 2 shows a partial cross-section along the line I—I in FIG. 1 greatly enlarged. Hereby is illustrated how a lateral guide between the trigger arm and the rear handle is arranged. The rear handle is shown only partly in a cross-sectional view.
Figure 3:
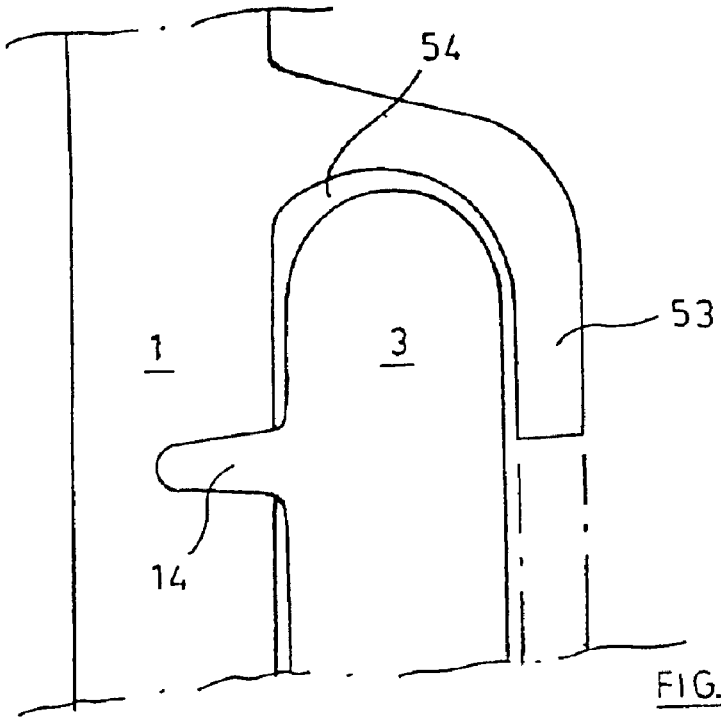
FIG. 3 illustrates an imagined partial cross-section corresponding to that in FIG. 2 but for a first alternative embodiment of the lateral guide between the trigger arm and the rear handle. The enlargement is approximately half as large as in FIG. 2. Only the outlines of the arm and the handle are shown.
Figure 4:
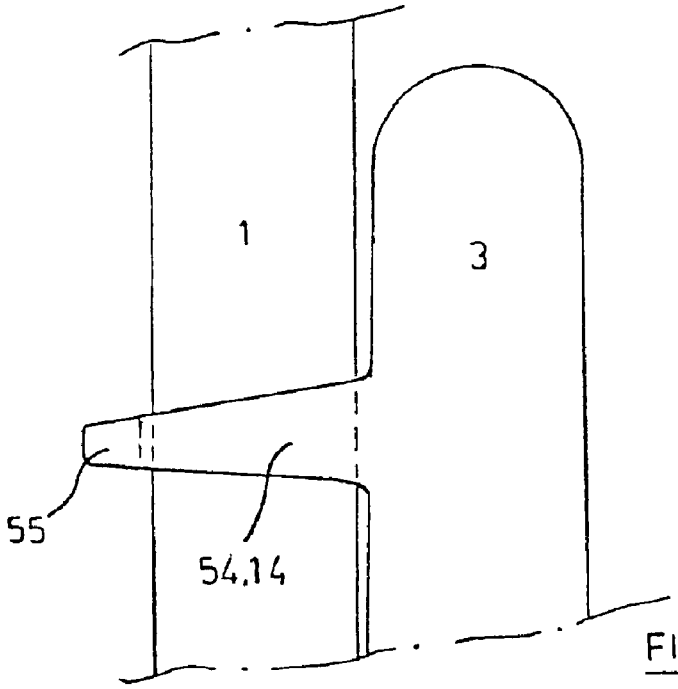
FIG. 4 illustrates an imagined partial cross-section corresponding to that in FIG. 3 but for a second alternative embodiment of the lateral guide between the trigger arm and the rear handle.

As becomes apparent from FIG. 1 the trigger arm 1 has a large total length. In the tough environments, these products are used; there is a great risk that the arm 1 might be under load in a lot of different directions also sideways. This would result in very heavy strains on the trigger arm 1 and its attachment at the pivot 10. Therefore the arm is preferably so embodied that it is laterally guided at a certain part of the trigger arm 1 located between its pivot 10 and its protruding outer end 13 above the rear handle. In the FIGS. 2–4 are shown some examples of such guides, which can be arranged in many different ways. For practical reasons it is preferable that the trigger arm 1 is located essentially on one side of the rear handle 3 and runs down on one side of the handle unit 15. In the shown examples, this is on the left side seen from the front and backwards in the direction of the saw. A location on the right side is of course also conceivable.

FIG. 2 shows thus a greatly enlarged partial cross-sectional view along the line I—I according to FIG. 1. The trigger arm 1 is provided with a protruding part 18, which is arranged so that it creates a groove 17 between itself and the other part of the trigger arm 1. A part 16, protruding from the handle, is shaped as a hook 16 or an L-profile and penetrates down in the groove 17. Thereby the lateral guide is created. The hook 16 is created in that there is an aperture between the end point 50 of the hook and the top edge 51 of the lateral wall 52 of the handle 3. Since this aperture normally points downwards there is little risk that dirt particles might penetrate into the handle through the aperture. However, obviously the parts could also be arranged inversely so that the aperture points upwards. The protruding part 18 is thus protruding up into this aperture, which has an adapted length perpendicularly to the plane of the paper, so that the protruding part 18, and consequently the trigger arm, can move a desirable distance in the corresponding direction. For, at least on one side of this aperture the protruding part from the handle 3, that is the hook 16, will preferably end up with a side wall or end wall.

Hereby there will be at least one end wall that connects the hook 16 with the side 52 of the handle 3. The lower part of the end wall extends between the points 50 and 51 according to the dash-doted line. This strengthens the hook 16 substantially at the same time as it preferably serves as an abutment 14 for the protruding part 18 of the trigger arm 1. The end wall is thus located above the plane of the paper. The abutment 14 is thus integrated with the lateral guide and both are arranged on the handle 3. The abutment could also be arranged somewhere else on the handle unit 15, e.g. so that it cooperates with the trigger arm at a part located between its pivot and its other outer end 19. However, preferably the abutment is arranged on the tool so that it cooperates with the trigger arm at a part located between its pivot 10 and its outer end 13 above the rear handle, so that, when the operator's hand or arm violently actuates the trigger arm, this will be pressed against the abutment 14, resulting in less strains on the lever and the transfer mechanism 6, 7, 8. The part of the trigger arm that is provided with this lateral guide can be either the bottom part 27, as shown in the figure, or the top part 28. This implies also the lateral guides according to the FIGS. 3 and 4.

FIG. 3 illustrates a trigger arm 1 with a protruding part 53, which is so adapted that it will create such a wide groove 54 between itself and the other part of the trigger arm 1 that the handle 3 goes into the groove 54. The trigger arm is thus sitting partly astraddle of the handle 3, which is illustrated by a continuous-line. However, the arm could also be drawn downwards, as shown by dash-dotted lines, so that it is situated completely astraddle of the handle 3. The downward extension of the part 53 could thus also be journalled in the handle unit 15. Thereby a considerably wider pivotal width for the trigger arm 1 will be created. The part 53 could also be made very thin since the leftwards forces give rise to tensions in the part 53, while any forces to the right will be taken up in that the arm 1 presses against the handle 3. A wider pivotal width would thereby result in a somewhat different lateral guide. Preferably the handle 3 also has a protruding abutment 14.

In FIG. 4 the abutment 14 is embodied as a protruding part 54, which has an outer part 55 creating a groove between itself and the very handle 3. The width of the groove is so adapted that the trigger arm can be displaced inside it. Thereby the trigger arm is laterally guided.

The lateral guides illustrated in the FIGS. 2–4 are all arranged at a part of the trigger arm that is located between its pivot 10 and its protruding outer end 13 above the rear handle. These guides are useful for a trigger arm both embodied as a double-armed lever and as a single-armed lever.

For a trigger arm embodied as a double-armed lever the lateral guide can be carried out both at the upper part of the trigger arm, as described above, or in the corresponding way at the lower part located between its pivot 10 and its other outer end 19. The trigger arm can also be laterally guided by resting against the handle unit 15 at an upper part when under load towards the handle unit, or, under load in the opposite direction, resting against the handle unit at a lower part located between the pivot 10 of the trigger arm and its other outer end 19. The trigger arm is thus in all cases laterally guided at least at one part of the trigger arm located between its pivot point and its respective outer end 13, 19.

So far we have examined the conditions valid for the bearing and guiding of the trigger arm 1. In the following will be described in short how the movement of the trigger arm 1 according to the arrow 29 actuates the brake 9 to stop the movement of the saw chain. As mentioned above the wire 6 is attached to the outer end 19 of the trigger arm. This wire extends inside its casing 7 up to a holder 46 mounted to the tool's engine body. The holder 46 has a traveling trolley 8, which is movable in the longitudinal direction of the holder and spring-loaded in the direction away from the trigger arm 1. The wire 6 is mounted to this traveling trolley 8. This means that when the trigger arm 1 rotates in the direction according to the arrow 29 the wire 6 will pull the trolley 8 against the spring-load from push-back spring 47. The traveling trolley 8 has an aperture 44. Into this aperture a pin will penetrate when mounting of the clutch housing. The pin is a part of a component of the brake 9. The brake 9 acts against the exterior periphery of a clutch drum 45, which rotates around crankshaft center 56, as becomes apparent from FIG. 1.

Figure 5:
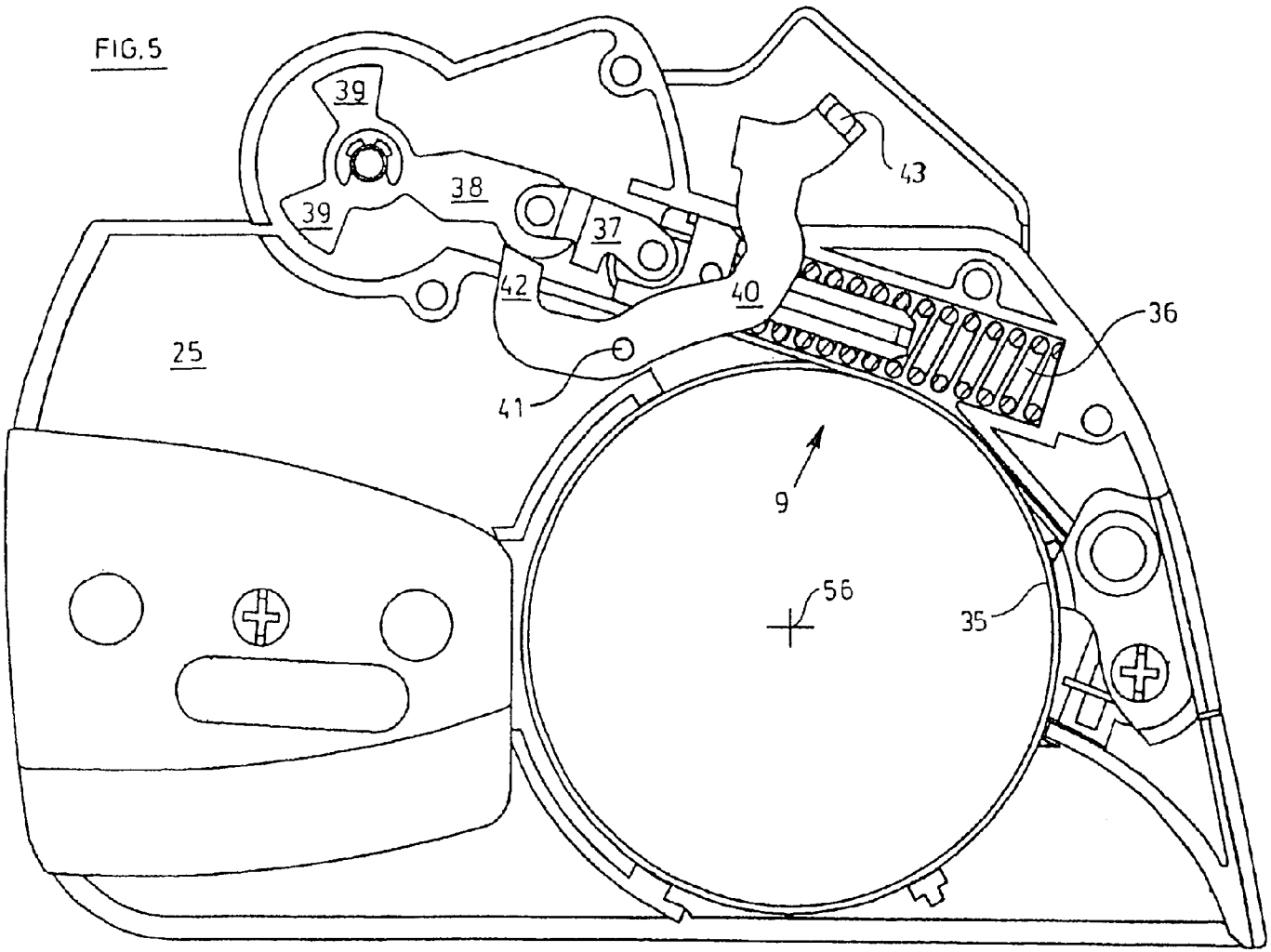
FIG. 5 shows from the side a clutch housing with a strap brake and a mechanism for actuating this. The clutch housing is shown from the opposite side and in a larger scale, compared to FIG. 1, i.e.
Figure 6:
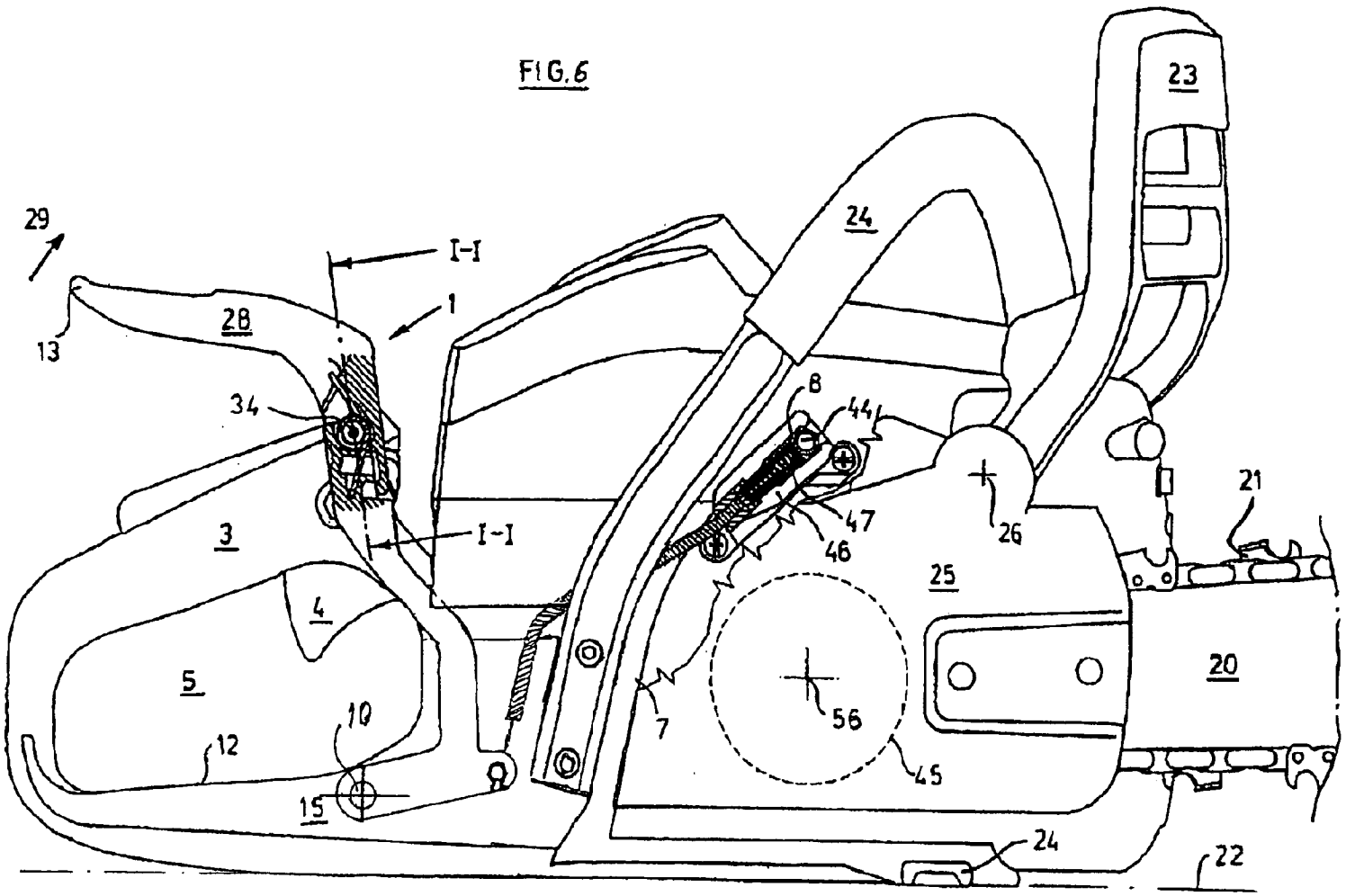
FIG. 6 shows a side view of a chain saw equipped with the trigger device in accordance with the invention.

FIG. 5 thus shows the clutch housing 25 from its rear side so that the brake 9 becomes apparent. The crankshaft center 56 becomes evident from FIG. 5 and FIG. 1. The clutch drum 45 rotates around this center. It has a cylindrical exterior surface, which on the inside is affected by the engine's centrifugal clutch, and on the outside is affected by a brake band 35 integrated with the brake 9, which is completely mounted into the clutch housing 25. The brake 9 has a brake band 35, which extends overbearingly one turn round the clutch drum 45. Its one end is attached to the clutch housing while its other end is attached to a compressed pressure spring 36. The pressure spring is held compressed by a toggle-joint mechanism 37 and 38. The part 38 has wing-shaped rejects 39. These are affected by the kickback guard so that the part 38 is rotated in the counter-clockwise direction when the kickback guard is pushed forwards towards the saw bar. Hereby the toggle-joint mechanism is no longer able to keep the pressure spring 36 compressed and thereby the pressure spring will pull the one end of the brake band 35 so that the brake band will tighten against on the inside rotating clutch drum. This is entirely conventional and will therefore not be described in further detail. However, on the other hand a pivotable arm 40 is pivoted to the pivot point 41 in the clutch housing. Its one end 42 is pressed onto the part 38 of the toggle-joint mechanism. The other end of the pivotable arm is provided with a pin 43. When mounting the clutch housing this pin will penetrate into the aperture 44 embodied in the trolley 8, which will be pulled by the triggering wire 6 in the holder 46 against the action from the push-back spring 47. Since the pin 43 fits in the aperture 44 the clutch housing does not have to be permanently connected to the triggering wire 6, which simplifies dismantling of the saw in most cases. Consequently, when the triggering wire 6 pulls the pin 43, the other end of the pivotable arm 40 will press on the part 38 of the toggle-joint mechanism so that this will be angled out and the spring 36 will be released in order to tighten the brake. After release, the trigger device will be reset to its origin position in that the kickback guard 23 is pulled against the handle frame 24 resulting in that the part 38 is rotated in the clockwise direction, according to FIG. 5.

What is claimed is:

1. A handheld chain saw (2) with a pivotably mounted trigger arm (1) located in connection to a rear handle (3) of the chain saw (2), which is also equipped with a front handle (24) with a kick-back guard (23) located in front of the front handle (24), the rear handle (3) being equipped with a throttle control (4) and a handle opening (5) located below the rear handle (3), so that the trigger arm (1), when the chain saw changes inclination in relation to an operator's forearm, is actuated by the operator's hand or arm, whereby the trigger arm (1) via a transfer mechanism (6, 7, 8, 40) actuates a brake (9) so that this stops the movement of a saw chain, wherein a pivot (10) of the trigger arm is located in connection to a front (11) or a bottom (12) side of the handle opening (5).

2. A handheld chain saw according to claim 1, wherein the pivot (10) of the trigger arm is located in front of the handle opening (5).

3. A handheld chain saw according to claim 1, wherein at least one of the trigger arm and a handle unit (15), which includes the rear handle (3), is so arranged that the trigger arm is laterally guided by at least a part of the trigger arm (1) located between its pivot and its respective outer end (13, 19).

4. A handheld chain saw according to claim 3, wherein the lateral guide is arranged at a part of the trigger arm (1) located between its pivot (10) and its protruding outer end (13) above the rear handle.

5. A handheld chain saw in according to claim 4, wherein the lateral guide includes a trigger arm protruding part (18), arranged so that it will create a groove (17) between itself and another part of the trigger arm, and a handle protruding part (16) shaped as a hook (16) or an L-profile, which protrudes down into the groove (17) and runs in it.

6. A handheld chain saw according to claim 1, wherein an abutment (14) is arranged on the tool so that it cooperates with the trigger arm at a part of the trigger arm located between its pivot (10) and its respective outer end (13, 19), so that when the operator's hand or arm violently actuates the trigger arm this will be pressed against the abutment (14), resulting in reduced load on the transfer mechanism (6, 7, 8).

7. A handheld chain saw according to claim 1, wherein the trigger arm is located on one side of the rear handle (3) and a therewith integrated handle unit (15) in front of the handle opening (5).

8. A handheld chain saw according to claim 1, wherein the trigger arm is embodied as a double-armed trigger arm, where its protruding outer end (13) is located above the rear handle and its other outer end (19) is connected to a part of the transfer mechanism (6).

9. A power tool, having a power driven tool implement that moves, and a rear handle for manual grasping by an operator of the power tool, the rear handle being located at a distal end portion of the power tool from the tool implement and partially bounding a handle opening, the handle opening having a rear side adjacent to an end of the tool, a front side closer to the tool implement than the rear side, and a bottom side adjacent to a bottom of the tool, the tool also having a front handle with a kick-back guard located in front of the front handle and the tool also having a brake mechanism actuatable for stopping movement of the tool implement, and a transfer mechanism for transferring an actuating force to the brake mechanism, the triggering device including:

a trigger arm pivotable responsive a condition associated with a desire to stop movement of the tool;

means pivotally mounting the trigger arm on the tool at a location adjacent to the rear handle, and means connecting the trigger arm to the transfer mechanism such that pivoting of the trigger arm transfers an actuating force to the brake mechanism;

wherein the means pivotally mounts the trigger arm on the tool at a location that is at least one of: (a) forward of the front side of the handle opening and (b) below the bottom side of the handle opening.

10. A power tool as set forth in claim 9, wherein the location that the trigger arm is pivotally mounted on the tool is adjacent to the front side of the handle opening.

11. A power tool as set forth in claim 9, wherein the location that the trigger arm is pivotally mounted on the tool is adjacent to the bottom side of the handle opening.

12. A power tool as set forth in claim 9, wherein the trigger arm has a portion that cooperates with a portion of the rear handle to guide pivot movement of the trigger arm.

13. A power tool as set forth in claim 12, wherein the trigger arm has an outer end located distal from the means pivotally mounting the trigger arm on the tool, the portion of the trigger arm that cooperates to guide pivot movement is located on the trigger arm between the outer end of the trigger arm and the means pivotally mounting the trigger arm on the tool.

14. A power tool as set forth in claim 9, wherein the tool has an abutment, the trigger arm having a portion engagable with the abutment during application of a force to the trigger arm to limit an amount of force transmitted to the transfer mechanism.

15. A power tool as set forth in claim 9, wherein the trigger arm extends along one lateral side of the rear handle.

16. A power tool as set forth in claim 9, wherein the trigger arm has a protruding part that partially bounds a groove on the trigger arm, the rear handle has a hook-shaped part protruding into the groove on the trigger arm, and the trigger arm protruding part and the hook-shaped part cooperate to guide pivot movement of the trigger arm.

17. A power tool as set forth in claim 9, wherein the means pivotally mounting the trigger arm on the tool pivotally supports the trigger arm at an intermediate location along the trigger arm, the trigger arm has a first portion, located on a first side of the means pivotally mounting, extending above the rear handle, and a second portion, located on a second side of the means pivotally mounting, interacting with the transfer mechanism.

18. A power tool as set forth in claim 9, wherein the trigger arm has two relatively movable parts.

19. A power tool as set forth in claim 18, wherein the means pivotally mounting the trigger arm on the tool mounts the trigger arm at a first of the trigger arm parts, and a second of the trigger arm parts is pivotable relative to the first trigger arm part.

20. A power tool as set forth in claim 19, wherein the trigger arm includes a bias spring, the second trigger arm part is biased by the spring toward a first pivot position relative to the first trigger arm part, and the second trigger arm part is pivotable toward a second pivot position relative to the first trigger arm part against the bias of the spring.

21. A power tool as set forth in claim 20, wherein the first position of the second trigger arm part is located relatively away from the rear handle and the second position of the second trigger arm part is located relatively toward the rear handle.

22. A power tool as set forth in claim 19, wherein force applied to the second trigger arm part in one direction causes pivot movement of the trigger arm relative to the tool at the means pivotally mounting the trigger arm on the tool, and force applied to the second trigger arm part in another direction causes pivot movement of the second trigger arm part relative to the first trigger arm part.

23. A power tool including:

a power driven tool implement that moves;

a rear handle for manual grasping by an operator of the power tool, the rear handle being located at a distal end of the power tool from the tool implement and partially bounding a handle opening, the rear handle opening having a rear side adjacent to an end of the tool, a front side closer to the tool implement than the rear side, and bottom side adjacent to a bottom of the tool;

a front handle with a kick-back guard located in front of the front handle;

a brake mechanism actuatable for stopping movement of the tool, implement;

a transfer mechanism for transferring an actuating force to the brake mechanism; and a brake triggering device including:

a trigger arm pivotable responsive a condition associated with a desire to stop movement of the tool;

means pivotally mounting the trigger arm on the tool at a location adjacent to the rear handle, and means connecting the trigger arm to the transfer mechanism such that pivoting of the trigger arm transfers an actuating force to the brake mechanism, the means pivotally mounts the trigger arm on the tool at a location that is at least one of: (a) forward of the front side of the handle opening and (b) below the bottom side of the handle opening.

24. A power tool as set forth in claim 23, wherein the location that the trigger arm is pivotally mounted on the tool is adjacent to the front side of the handle opening.

25. A power tool as set forth in claim 23, wherein the location that the trigger arm is pivotally mounted on the tool is adjacent to the bottom side of the handle opening.

26. A power tool as set forth in claim 23, wherein the trigger arm and the rear handle have cooperating portions that guide pivot movement of the trigger arm.

27. A power tool as set forth in claim 26, wherein the trigger arm has an outer end located distal from the means pivotally mounting the trigger arm on the tool, the portion of the trigger arm that cooperates to guide pivot movement is located on the trigger arm between the outer end of the trigger arm and the means pivotally mounting the trigger arm on the tool.

28. A power tool as set forth in claim 23, wherein the tool has an abutment, the trigger arm having a portion engagable with the abutment during application of a force to the trigger arm to limit an amount of force transmitted to the transfer mechanism.

29. A power tool as set forth in claim 23, wherein the trigger arm extends along one lateral side of the rear handle.

30. A power tool as set forth in claim 23, wherein the trigger arm has a protruding part that partially bounds a groove on the trigger arm, the rear handle has a hook-shaped part protruding into the groove on the trigger arm, and the trigger arm protruding part and the hook-shaped part cooperate to guide pivot movement of the trigger arm.

31. A power tool as set forth in claim 23, wherein the means pivotally mounting the trigger arm on the tool pivotally supports the trigger arm at an intermediate location along the trigger arm, the trigger arm has a first portion, located on a first side of the means pivotally mounting, extending above the rear handle, and a second portion, located on a second side of the means pivotally mounting, interacting with the transfer mechanism.

32. A power tool as set forth in claim 23, wherein the trigger arm has two relatively movable parts.

33. A power tool as set forth in claim 32, wherein the means pivotally mounting the trigger arm on the tool mounts the trigger arm at a first of the trigger arm parts, and a second of the trigger arm parts is pivotable relative to the first trigger arm part.

34. A power tool as set forth in claim 33, wherein the trigger arm includes a bias spring, the second trigger arm part is biased by the spring toward a first pivot position relative to the first trigger arm part, and the second trigger arm part is pivotable toward a second pivot position relative to the first trigger arm part against the bias of the spring.

35. A power tool as set forth in claim 34, wherein the first position of the second trigger arm part is located relatively away from the rear handle and the second position of the second trigger arm part is located relatively toward the rear handle.

36. A power tool as set forth in claim 33, wherein force applied to the second trigger arm part in one direction causes pivot movement of the trigger arm relative to the tool at the means pivotally mounting the trigger arm on the tool, and force applied to the second trigger arm part in another direction causes pivot movement of the second trigger arm part relative to the first trigger arm part.

* * * * *